US005558135A

United States Patent [19]

Kronseder et al.

[11] Patent Number: 5,558,135

[45] Date of Patent: Sep. 24, 1996

[54] PROCESS AND DEVICE FOR THE STERILE FILLING OF BEVERAGE LIQUIDS

[75] Inventors: Hermann Kronseder, Woerth; Wilhelm Weiss, Lappersdorf, both of Germany

[73] Assignee: Krones AG Hermann Kronseder Maschinenfabrik, Germany

[21] Appl. No.: 487,863

[22] Filed: Jun. 7, 1995

Related U.S. Application Data

[63] Continuation of Ser. No. 938,168, filed as PCT/EP91/00953, May 22, 1991, abandoned.

[30] Foreign Application Priority Data

Jun. 6, 1990 [DE] Germany ..... 40 18 122.7
Nov. 14, 1990 [DE] Germany ..... 40 36 290.6

[51] Int. Cl.[6] ..... B67C 3/10

[52] U.S. Cl. ..... 141/6; 141/39; 141/48; 141/63; 141/92

[58] Field of Search ..... 141/6, 39, 40, 141/47–51, 59, 61, 63, 64, 91, 92, 302

[56] References Cited

U.S. PATENT DOCUMENTS

| | | | |
|---|---|---|---|
| 2,695,743 | 11/1954 | Wetherby-Williams | 141/40 |
| 4,832,096 | 5/1989 | Kohlbach | 141/91 X |
| 4,982,768 | 1/1991 | Ahlers | 141/6 |
| 4,989,650 | 2/1991 | Weiss | 141/6 |
| 5,031,673 | 7/1991 | Chusserath | 141/6 |

FOREIGN PATENT DOCUMENTS

| | | |
|---|---|---|
| 0303135A1 | 2/1989 | European Pat. Off. . |
| 0334288A1 | 9/1989 | European Pat. Off. . |
| 0341626A1 | 11/1989 | European Pat. Off. . |
| 1294254 | 4/1969 | Germany . |
| 3825093A1 | 1/1990 | Germany . |
| 3836489A1 | 5/1990 | Germany . |

*Primary Examiner*—J. Casimer Jacyna
*Attorney, Agent, or Firm*—Finnegan, Henderson, Farabow, Garrett & Dunner

[57] ABSTRACT

A process and a device for the sterile filling of beverage liquids. In the process and device a bottle is sterilized by passing steam into it through a short feed pipe. All other phases such as $CO_2$ flushing, counter-pressurizing and return gas discharge also take place through the feed pipe. During the filling process the liquid to be filled flows into the bottle around the feed pipe.

13 Claims, 4 Drawing Sheets

PROCESS AND DEVICE FOR THE STERILE FILLING OF BEVERAGE LIQUIDS

This application is a continuation of application Ser. No. 07/938,168, filed as PCT/EP91/00953, May 22, 1993, now abandoned.

BACKGROUND OF THE INVENTION

The invention relates to a process for the sterile filling of beverage liquids into bottles or the like. Moreover, the invention relates to a device with which such a process can be carried out.

As is generally known, one attempts during the filling of beverages to fill the beverages in such fashion so as to achieve a shelf life as long as possible. If one does not want to achieve this with chemical additives or a subsequent pasteurization by means of heating, one is dependent on carrying out the filling process as germ-free as possible, i.e. sterilely, so that no bacteria reducing the shelf life of the filled product remain in the product during the filling process. Advantages of a germ-free or sterile filling result in particular in the case of fruit juices, but also in the case of beer or similar beverages.

In order to achieve a high degree of sterility during the filling process, it is known to carry out a steam sterilization of the bottles. During this steam sterilization phase the bottles (this applies, of course, also to beverage cans) are flushed with hot steam. For this purpose, it has been already suggested (U.S. Pat. No. 2,695,743) to bring steam into the opening area of the bottle through a short filling pipe located above the bottle edge for steam sterilization, which extends into the bottle neck with its opening during the filling process, by bringing the filling pipe into flow connection with the steam feed line. After steam flushing of the opening area, the filling pipe is then inserted and the liquid to be filled is then filled into the bottle through the filling pipe, through which the steam has also been introduced.

The relatively large control expenditure required is disadvantageous in this process. Moreover, this process has been criticized (cf. EP-A-0303135) because sufficient sterilization, in particular of the inner space of the bottle, is not possible because of the short filling pipe.

To avoid this disadvantage a long steam feed pipe is used in EP-A-03 03135, in which a steam sterilization phase is also provided, which pipe is introduced so much into the bottle in the steam sterilization phase that the opening area of the steam feed pipe is only insignificantly above the bottom of the bottle to be sterilized. Then, the steam flows upwardly from the bottle bottom along the walls. Moreover, a bell is put over the bottle in the steam sterilization phase. A steam atmosphere is also generated within the bell so that the bottle is then treated with hot steam from the outside and the inside.

The disadvantage of this process is, on the one hand, the large expenditure necessary for the sterilization phase (additional bell), however, it is also particularly disadvantageous that, due to the long steam feed pipe, great relative displacements must take place between filling element and bottle, which, in turn, is connected with the corresponding apparatus expenditure and additional process time during lifting and lowering. Moreover, the long pipe has a comparatively high heat storage capacity so that, following the completion of a filling cycle, the filling pipe cooled by the liquid filled must again be heated, whereby a lot of undesired condensate is obtained.

As compared with this prior art, the invention provides a process and a device with which a simple and effective, sterile bottling is possible, which covers a large field of application.

SUMMARY OF THE INVENTION

According to the process of the invention, the bottle is first of all moved from below towards the filling element in a positioning phase, this movement taking place at least until the opening of a short steam feed pipe provided on the filling element comes to rest within the opening area of the bottle head. Then steam is introduced into the bottle through the steam feed pipe in a subsequent sterilization phase, the steam being directly introduced into the bottle in targeted fashion and, thus, can flow downwardly in a relatively powerful and bundled jet and thereby can reach all areas of the bottle, including the bottle bottom and the corner areas between the bottom and walls. The steam feed can be maintained up to a specific pressure in the interior of the bottle.

After this sterilization phase the bottle is counter-pressurized in a manner known per se with an inert counter-pressure gas, a counter-pressure being generated in the bottle, which, for instance, automatically opens the liquid valve in the filling element when a specific value is reached.

Then, a beverage liquid is filled into the bottle in the filling phase, which flows around the outer casing of the steam feed pipe. "Flowing around the outer casing" means that the liquid is not supplied in the interior of the steam feed pipe, but in the area between the inner wall of the bottle and the outer casing of the steam feed pipe. The flowing around the outer casing can take place in direct or indirect contact with the outer casing. Due to the fact that the liquid to be filled is filled into the bottle flowing around the outer casing, the steam feed pipe which is still hot due to the preceding sterilization phase can directly or indirectly heat the liquid to be filled somewhat on a relatively large area, namely the circumferential surface of the steam feed pipe. This heating stems from the fact that the cold liquid must not impinge directly against the inner wall of the bottle, which has been heated during the preceding sterilization phase, but that a certain reduction of the difference in temperature must occur to reduce the risk of a breaking of the bottles due to otherwise possible large differences in temperature. During this filling process the counter-pressure gas is displaced and discharged through the steam feed pipe as return gas. After the desired filling level has been reached, the bottle is then finally downwardly withdrawn from the filling element in a manner known per se.

Since, as opposed to the prior art according to U.S. Pat. No. 2,695,743, the short steam feed pipe is already located in the area of the bottle opening in the sterilization phase and no displacement of the steam feed pipe is necessary for the filling process, a more simple and more effective possibility of carrying out the sterilization phase results, as opposed to this prior art, on the other hand, there is no necessity of the long lifting movement as is the case in EP-A-0303135. Consequently, the process according to the invention can be carried out in a simple and, nevertheless, efficient fashion. Since completely separate ducts are used for guiding the liquid and the process gases, the liquid duct below the liquid valve can be kept free from gates for gas ducts, whereby a flow with little resistance and eddies and a good cleaning results. Moreover, the gas ducts connected to the steam feed pipe practically do not come into contact with the material to be filled, which avoids the formation of germ sources.

The invention also includes various variants which further develop the process according to the invention.

In one of these advantageous variants, the bottle is only lifted to shortly below the filling element without being pressed against the filling element in the positioning phase, and the sterilization phase is carried out in this position. In this variant, as well, care is taken that the opening of the steam feed pipe is already located in the bottle neck, when the lifting movement of the bottle is stopped. In the steam phase, steam can then flow through the bottle and is upwardly discharged from the bottle into the open air between steam feed pipe and bottle neck so that then the upper bottle edge and in particular the area, where the bottle closure is later affixed, outside the bottle is also subjected to the sterilization treatment. Thus, a sterilization of the opening takes also place from the outside. During the further course, the bottle can be pressed tightly against the filling element with simultaneously continued steam feed.

According to a further variant a pre-flushing phase can also follow this sterilization of the opening, during which inert counter-pressure gas is again introduced into the bottle, which then has the purpose of flushing the hot steam out of the bottle. If, during this flushing phase, the bottle is further lifted after the expelling of the hot steam, until it rests sealingly against the filling element, it can be directly changed over to the counter-pressurizing phase from this flushing phase, in which a counter-pressure is generated in the bottle for the subsequent opening of the filling valve.

In a further variant, the bottle is already pressed against a seal of the filling element in the positioning phase. A pre-evacuation of the bottle can be carried out between the positioning phase carried out in this fashion and the sterilization phase. For this purpose, the steam feed pipe is preferably also used again by connecting it to a vacuum line. After this first pre-evacuation, the sterilization phase can then take place, which can then again be followed by an evacuation phase for steam removal.

In another process variant, a pre-flushing phase is carried out with counter-pressure gas introduced through the steam feed pipe after the sterilization phase and, during the pre-flushing phase, the steam and the condensate are blown out through a discharge line open towards the bottle opening during this pre-flushing phase.

In this variant, the bottle is also pressed against a seal of the filling element; however, the pressing pressure must at first only be such a pressure that the bottle rests tightly on the filling element. If, after the sterilization phase, which must not have been preceded by any pre-evacuation phase, the pre-flushing phase is initiated, the introduced counter-pressure gas can press the steam and in particular the condensate collected on the bottle bottom during the sterilization phase upwardly out of the bottle, this hot steam not being released into the open air, where it could possibly affect adjacent bottles, but being supplied to a discharge line, where it can then be discharged in targeted fashion at a suitable point. The discharge line can be closed to terminate the pre-flushing phase so that the gas introduced first of all as flushing gas no longer escapes, and this is then followed by the counter-pressurizing phase. In an advantageous design the discharge line is closed by a lifting movement of the bottle. This can be effected by further lifting the bottle after the completion of the pre-flushing phase, the closing of the opening of the discharge line taking automatically place due to a suitable design of the centering bell.

In a further, very advantageous embodiment of the invention the liquid is directed to the inner wall of the bottle head by means of a baffle body provided in the bottle opening. The purpose of this baffle body is to direct the liquid toward the inner wall of the bottle directly in the opening area of the bottle, where it is then received and flows downwardly along the inner wall of the bottle under the adhesion effect. Thus, a uniform cooling of the bottle which takes place from the top to the bottom results in the filling process, which begins in the especially thick-walled head area of the bottle so that no temperature shocks, and thus a breaking of bottles, occurs.

It can be provided in the withdrawal phase in all process variants that the bottle is only partly with-drawn from the filling element and that then a flushing of the opening area of the filled bottle takes place by means of the blowing of inert counter-pressure gas, which is then again guided through the steam feed pipe. Therafter, the bottle can be completely withdrawn from the filling element. An inert atmosphere is created in the area of the bottle opening, as known per se, with this reflushing so that the interior of the bottle does not come into contact with air possibly still containing germs until its closing.

A filling element designed for carrying out the process according to the invention comprises a liquid valve and feed ducts for the filled liquid and for an inert counter-pressure gas and a short steam feed pipe and is characterized in that the steam feed pipe traverses the liquid valve and a chamber located above the liquid valve and acted upon by liquid also with closed liquid valve and that the feed line for the inert counter-pressure gas, possibly a feed line for a vacuum and a feed line for hot steam are connected to the steam feed pipe above the liquid valve.

A liquid element is created with these features, in which the steam feed pipe does not only traverse the liquid valve, but also a chamber located above it and acted upon by product liquid, which entails that that in the sterilization phase with hot steam, the steam guided through the steam feed pipe can also deliver heat to the liquid valve, on the one hand, and the product located in this area, on the other, so that the product is somewhat pre-warmed with the result described above that the differences in temperature are less upon impingement on the bottle wall. In addition to these advantages, a significant simplification results due to the fact that the steam feed pipe not only serves for feeding hot steam, but also as a feed pipe for the counter-pressure gas and for the vacuum. Due to the fact that the individual process steps such as flushing with inert counter-pressure gas, pre-evacuation, flushing with hot steam are always carried out separately, it is possible to control all these processes by the steam feed pipe. This not only results in a simplified construction, but, moreover, has the advantage that, during the sterilization phase, the counter-pressure gas line and the vacuum line and the return gas line are acted upon by hot steam up to the corresponding valves, and thus are also sterilized again and again so that a possible transmission of bacteria cannot take place from one filling process to the next filling process.

In a specific embodiment the feed line for the inert counter-pressure gas, the feed line for the vacuum and the feed line for steam open into a joint connection line, which, in turn, opens again into the steam feed pipe.

Moreover, the steam feed pipe can also be used for relieving the filled bottle to atmospheric pressure.

The seal against which the bottle is pressed on the centering bell is advantageously part of a vertically movable centering bell, which forms a chamber above the bottle opening in an embodiment in a first position. In this situation the bottle is pressed against the centering bell, however, a chamber is formed in the centering bell around the opening area which makes it possible to blow the hot steam from the bottle into the chamber and via the chamber into a discharge line opening there during the flushing phase. In a second position in which the centering bell is still further lifted, parts of the centering bell can close the outlet opening of the discharge line if they are correspondingly designed so that the necessary counter-pressure can be built up again in the bottle during the counter-pressurizing phase, as desired.

Moreover, it is very advantageous to design the steam feed pipe as an annular nozzle at least in the opening area towards the bottle. This can e.g. be done by disposing a probe in the interior of the steam feed pipe which serves for detecting the filling level. This probe has a flow-guiding effect on the steam flow during the sterilization phase, which leads to a correspondingly bundled steam jet, which is directed towards the bottom of the bottle and can then spread upwardly from there along the walls of the bottles.

BRIEF DESCRIPTION OF THE DRAWINGS

The invention is further explained in the following by means of examples of embodiments which are represented in the drawings.

DETAILED DESCRIPTION OF THE INVENTION

Figure 1:
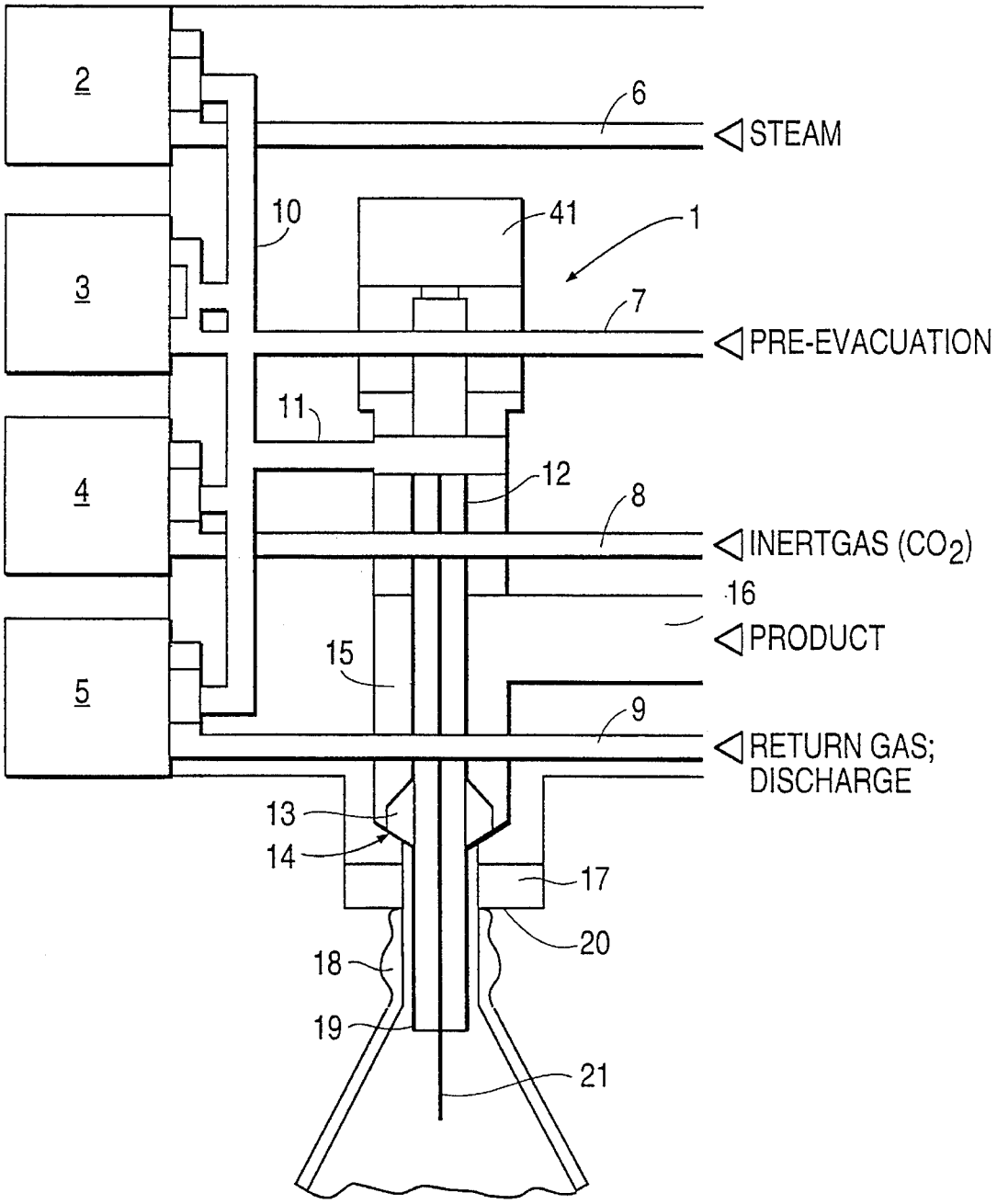
FIG. 1 is a schematic representation of the structure of a filling element according to the invention.

A filling element is schematically represented in FIG. 1 and designated with 1. This filling element is part of a counter-pressure filling machine (not shown), whose fundamental structure is known and need not be further explained here. In this connection, reference is e.g. made to DE-OS 38 25 093 or DE-OS 38 36 489. The fundamental structure of such machines is described in these publications.

Various valves 2, 3, 4 and 5 located in a valve block are allocated to the filling element 1. The valve 2 serves as a steam valve and is connected to a steam feed line 6 at its inlet side. The valve 3 serves for pre-evacuation and is connected to an evacuation line 7 at its inlet side. The valve 4 serves as an inert gas valve and is connected with an inert gas line 8 at its inlet side for this purpose. Finally, the valve 5 serves as a return gas valve for exhausting return gas via a return gas line 9. All of valves 2 to 5 are connected to a common line 10 at their outlet sides, which, in turn, is connected to the upper end of a steam feed pipe 12 via a connection line 11. This steam feed pipe extends through the valve body 13 of a liquid valve 14. A product collection chamber 15 is located above liquid valve 14, into which product line 16 opens. A drive means 41 for the filling element is housed in the head of the filling element, which to opens or closes the liquid valve 14 at the appropriate in time.

In the position shown, the head 18 of a bottle to be filled rests against a lower seal 17 of the filling element. The steam feed pipe 12 ends in the area of the bottle neck with its outlet opening 19 being below the bottle opening 20. Moreover, a probe 21 is located in the steam feed pipe, which serves as a filling level detector probe and emits signals for terminating the filling process if the probe comes into contact with liquid during the filling process. The outlet opening 19 can advantageously ends above the required filling level so that no liquid penetrates into the interior of the steam feed pipe. The valves 2 to 5 are opened or closed electrically or also mechanically depending upon the desired process sequence.

The process according to the invention can be carried out in differint ways with such a filling element.

Figure 2:
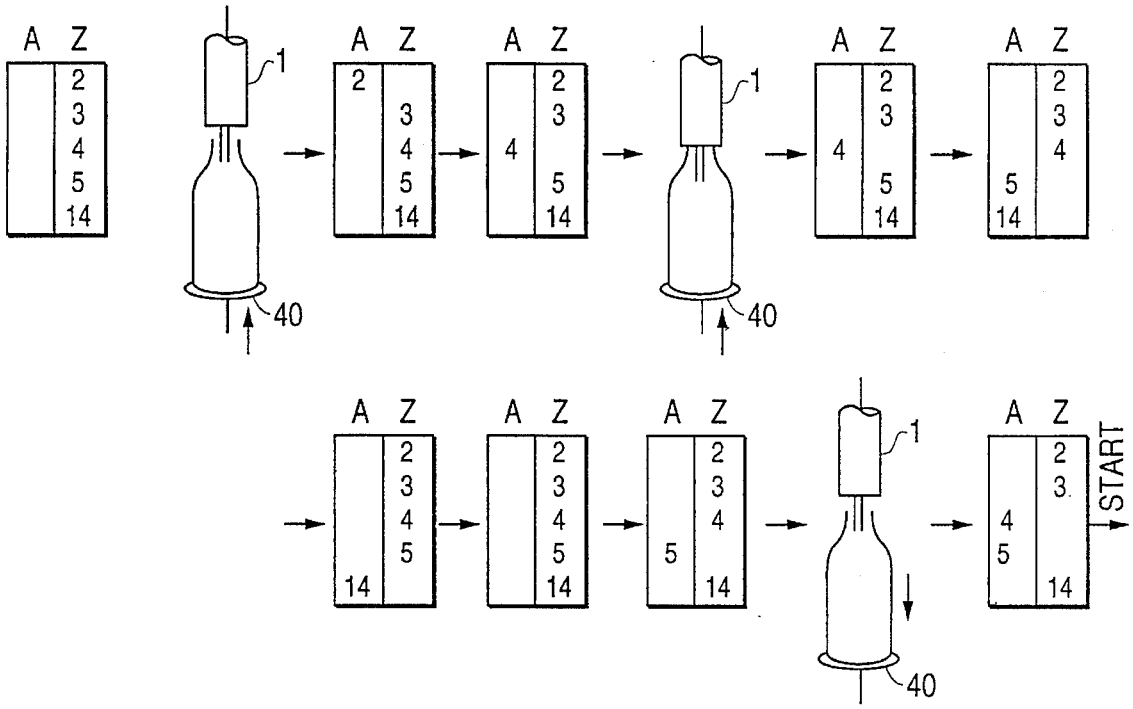
FIG. 2 shows the individual phases of the process according to the invention according to a first variant.

A first such way is explained in the following in greater detail with reference to FIG. 2. The individual positions of the various valves during the individual phases of the filling process are represented in FIG. 2 (and in FIG. 3). The open valves are located in the lefthand column of each box marked "A". The closed valves in the individual phases are shown in the righthand column marked "Z". The numbers in the column correspond to the reference numerals of the valves in FIG. 1, i.e. 2 is the steam valve, 3 is the pre-evacuation valve, 4 is the inert gas valve and 5 is the return gas valve. The filling valve is designated with 14.

According to a first variant represented in FIG. 2, a bottle is positioned against the filling element 1 by lifting a lifting plate 40 on which the bottle stands during the positioning phase so that the upper edge of the bottle is not pressed against the seal 17 (cf. FIG. 1) of the filling element, but is located in a spaced relationship thereto. The opening 19 of the steam feed pipe 12 is then already located within the head 18 of the bottle. All valves 2 to 5 and 14 are closed. In the next step, the steam valve 2 is opened first of all. As a result, hot steam flows into the bottle. The hot steam reaches all areas of the bottle and then escapes into the open air through the gap between the steam feed pipe and the bottle head. The head area of the bottle is also sterilized from the outside and is thus germ-free. Therefore, this phase is the sterilization phase. The steam valve 2 is then closed to terminate the sterilization phase. Then a pre-flushing phase follows, during which a flushing of the bottle is carried out with inert gas, namely $CO_2$. For this purpose, the $CO_2$valve 4 is opened. The $CO_2$ also flows through the steam feed pipe into the bottle, is distributed uniformly therein, displaces the still present residual steam and passes out the opening 20 and into the space between. the bottle opening 20 and the lower seal 17 on the filling element, which space is still present in this phase. With the $CO_2$ valve open, the bottle is then moved against the seal 17 by further lifting the lifting plate 40. This is shown by the arrow with the corresponding representation in the functional sequence. A counter-pressure is now formed in the bottle by the further introduction of $CO_2$ with the $CO_2$ valve open, which finally leads to the opening of the filling valve 14. This phase is called counter-pressurizing phase. With the opening of the filling valve 14, the return gas valve 5 is also opened, and the $CO_2$ valve 4 is then closed. Now the filling phase takes place, with liquid flowing into the bottle and $CO_2$ escaping from the bottle through the return gas valve 5. For decelerating the filling process, the return gas valve can be periodicially opened and closed by drive means 41 to decelerate the flowing in of the liquid. When the desired filling level is reached, the filling valve 14 is closed again. Then relief can take place in known fashion by again opening the return gas valve 5.

As shown in FIG. 2 then the bottle can be lowered somewhat from the seal on the filling element by lowering the lifting plate 40 partially so that a is again formed between the upper edge of the bottle and the seal. Now, the $CO_2$ valve 4 can be opened again so that a $CO_2$ atmosphere is created in the opening area which prevents the penetration of air, and thus of any germs, into the interior of the bottle.

After the completion of this re-flushing phase, all valves are closed, and the bottle is then completely withdrawn from the filling valve. The, starting position is then adopted again, and the filling process can start accordingly with the next bottle.

Figure 3:
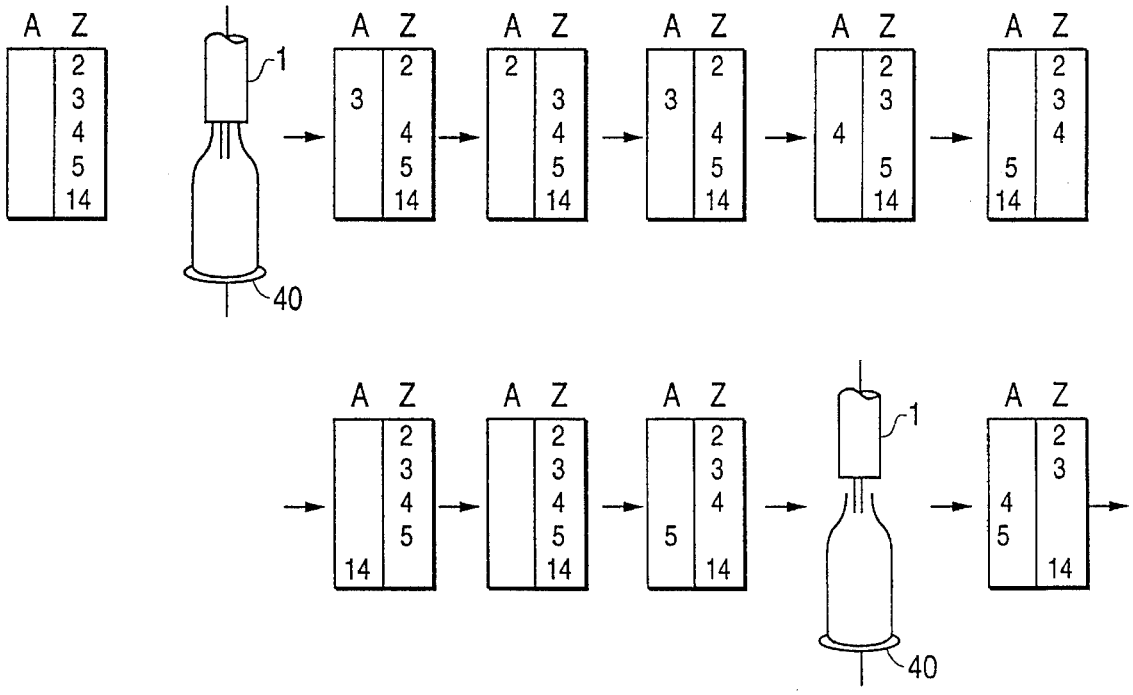
FIG. 3 shows the individual phases of a second process variant according to the invention.

In another variant represented in FIG. 3, the bottle is first pressed completely against the seal 17 of the filling element in the positioning phase so that no open space, as in the first example, remains between the upper bottle edge and filling element seal. Next, a pre-evacuation phase follows by opening the valve 3. Only then is the sterilization phase begun. For this purpose, the pre-evacuation valve 3 is closed and the steam valve 2 is opened. This sterilization phase can again be followed by an evacuation phase, during which the steam is removed from the bottle by means of the generation of a vacuum. This is followed by the counter-pressurizing phase. For this purpose, the $CO_2$ valve is opened, and an excess pressure is generated in the bottle, which then leads to the opening of the filling valve so that it is then passed over to the filling phase. The further steps correspond to those as they have been explained by means of FIG. 2,so they need not be repeated.

The filling valve shown in FIG. 1 can be used with these various filling processes. As shown in FIG. 1, the outlet lines of the individual valves 2 to 5 communicate with a common line 10, which, in turn, opens into a connecting line 11. This means that the each of valves opens into the steam feed pipe 12 via a single line. This not only leads to a simple structure for the filling element, but also ensures that all lines to the individual valves are also sterilized with hot steam during the sterilization phase. This leads to a high degree of sterility in the entire line system. Since the product fed in through line 16 is located above the filling valve 13 when the filling valve 13 is closed and since the steam feed pipe 12 extends through this chamber 15, a partial amount of the liquid to be filled, namely that which is the first to flow into the bottle, is pre-warmed, which can prevent a temperature shock in the bottle with the possibly resultant breaking of the bottle. Since, moreover, the product liquid flows around the outer casing of the steam feed pipe when the filling valve is opened, a further heating is effected by this, and, moreover, the bottle is already cooled from the head by the product liquid flowing along the walls directly upon entering into the bottle. Due to this which takes place continuously, a temperature shock is also prevented. This were be different if the product liquid would be filled through the steam feed pipe because, then an uncontrolled flowing against the bottle wall would occu, and thus the risk of local temperature shocks would be greater.

Figure 4:
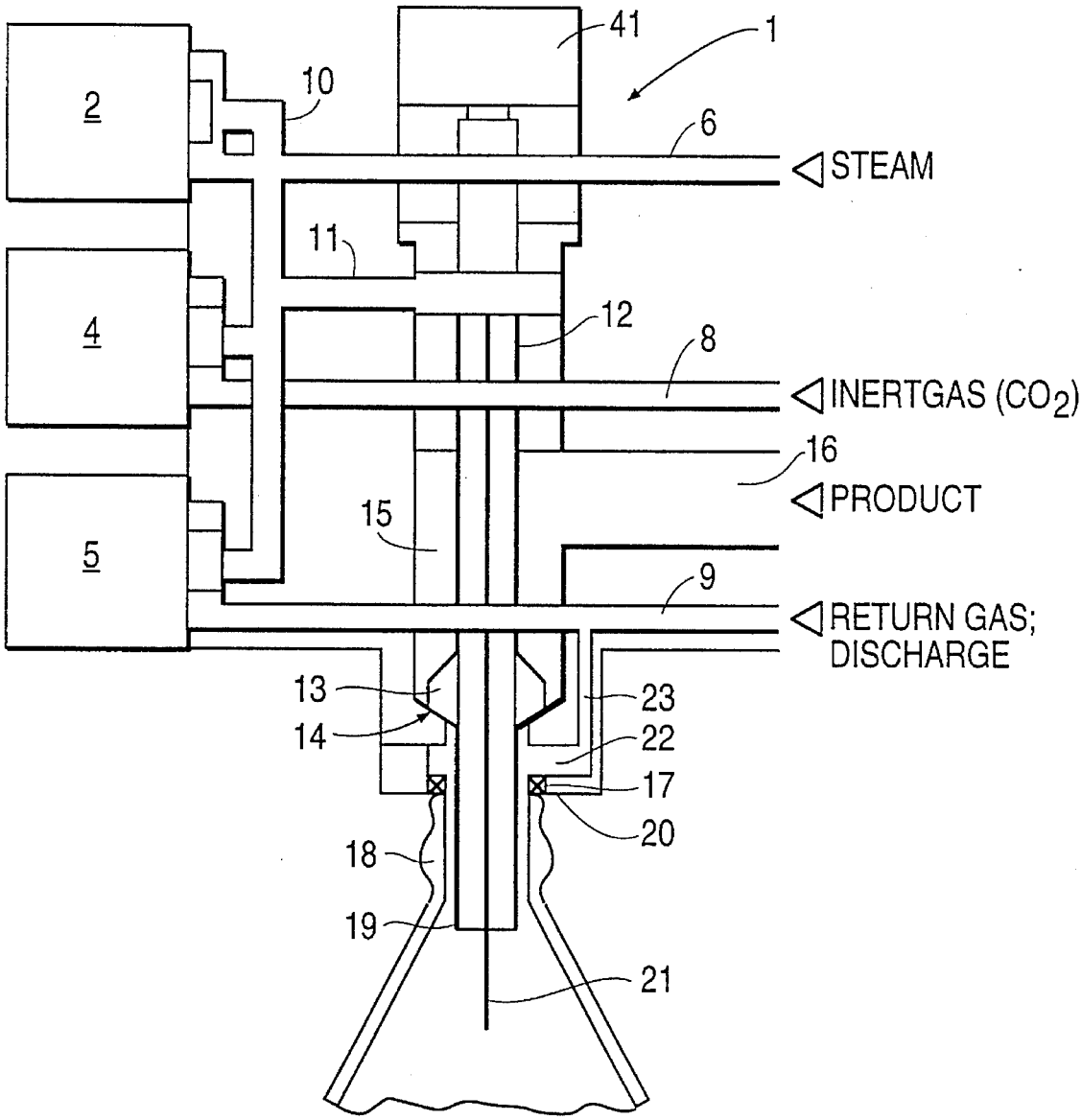
FIG. 4 is the schematic representation of a further embodiment of a filling element.

The example of embodiment shown in FIG. 4 differs from the embodiment according to FIG. 1 in that the pre-evacuation line 7 and the pre-evacuation valve 3 are eliminated and a chamber 22 is formed in the area of the seal 17, which is part of the centering bell not represented in greater detail, whose function is to be further explained. The chamber 22 is in communication with a discharge line 23 in the position shown in FIG. 4, which, in turn, opens into the return gas line 9.

In this of embodiment, the bottle is pressed in two stages against the seal 17 in the centering bell. In a first stage only a sealing abutment of the opening 20 of the bottle to the centering bell results. If, after the sterilization phase, the steam is forced out of the bottle during the subsequent flushing phase with $CO_2$, the steam and also any condensate are pushed into the chamber 22 and into the return gas line through the discharge line 23, because then there is a flow connection between the annular chamber around the steam feed pipe and the chamber 22 and thus also to the discharge line 23. After the termination of the blowing out of steam during the flushing phase, the bottle can be further lifted in a second stage, the seal 17 moving upwardly, namely in such fashion that it reduces the volume of the chamber 22 and/or completely occupies the volume of the chamber 22 so that then there is no longer any flow connection to the discharge line 23. Then the pressure can build up. The following steps result in this type of process sequence:

At first, the bottle is moved up to the position shown in FIG. 4, where it rests against the seal 17 of the filling element in a pressure-sealed fashion. The sterilization phase can directly follow, steam being blown into the bottle via the steam feed line and the steam feed pipe. The gas located in the bottle escapes through the discharge line, because the chamber 22 is opens to this line. There-after, the pre-flushing phase can follow, inert gas being introduced under pressure via line 8. This inert gas forces the hot steam and the condensate into the return gas duct 9 via the same discharge line. Then the bottle is further lifted, the seal 17 moving upwardly and sealing the discharge line and the chamber 22. Now, counter-pressure can be built up in the bottle, which then leads ultimately, in the manner already described, to the lifting of the filling valve 13 and thus to the beginning of the filling phase. The remaining phases take place in accordance with the embodiment described above.

Figure 5:
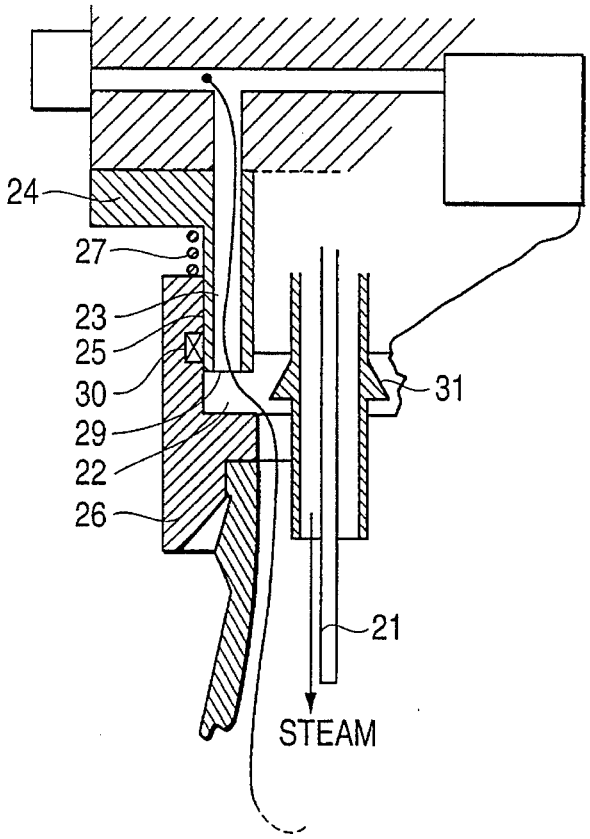
FIG. 5 is a partial sectional view of a more specific filling element working according to the principle explained in of FIG. 4 in a pre-flushing phase.
Figure 6:
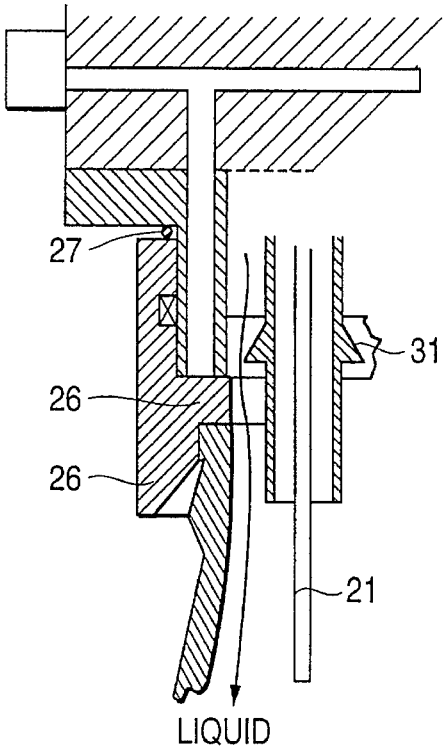
FIG. 6 is the filling element of FIG. 5 in a filling phase.

The discharge area of the filling element can be designed more specifically as shown in FIGS. 5 and 6. As can be seen, a bottom element 24 is affixed to the lower area of the filling element, having a lug 25 which serves to guide a centering bell 26. The centering bell 26 is mounted vertically movably against the force of a spring 27 with respect to the lug 25. Moreover, the centering bell has a closing surface 28 that closes against to opening 29 of the discharge line 23. The position of the centering bell as shown in FIG. 5, is during the sterilization phase. It can be seen that chamber 22 communicates with to the interior of the bottle, on the one hand, and with the discharge line 23, on the other. The introduced steam can thus pass out through by this discharge line during the sterilization phase and transported to a desired point via the discharge or return gas lines. The guiding of the centering bell with respect to the lug 25 on the flange 24 is effected with an easy-running seal 30 which prevents the steam from escaping through the gap between the centering bell and the lug.

As opposed to the variant represented in FIG. 4, the discharge line 23 need not necessarily open into the return gas duct 9. It is also possible to have line 23 open directly into the open air via a separately drivable valve or to also optionally connect it to a vacuum in order to be able to carry off e.g. flushing gas, steam or also condensate.

During a further lifting of the bottle, the position is reached as shown in FIG. 6. The closing surface 28 closes the opening of the discharge line 23 so that now there is no connection between the interior of the bottle and the discharge line. During this phase, the filling process is then carried out.

Finally, it is to be noted that the steam feed pipe is designed as an annular nozzle due so that the probe 21 extends centrically through this pipe, which has a constricting effect on the steam jet, the result of this being that the steam jet can be directed in targeted fashion towards the bottom of bottle. Finally, a baffle body 31 as seen in FIG. 6, is located on the outer casing of the steam feed pipe and has the purpose of directing the flow of liquid in the direction of the arrow shown in FIG. 6 along the inner wall of the head of the clamped bottle during the filling phase, which then leads in the manner already described to the liquid flowing down along the inner wall of the bottle.

A sterile filling not only of bottles, but of cans or other receptacles can be carried out in a simple and efficient fashion with the filling element according to the invention and the process steps according to the invention without it having to be worked with a long pipe and without the occurrence of the disadvantages which must be put up with in known short-pipe filling means used for this purpose of sterile filling.

The described processes and the associated filling valve with a steam feed pipe can also be used in a filling element with a centering seal guided displaceably in controlled fashion along the filling spout, it being possible that the steam feed pipe is displaceably mounted in the filling valve and connected with the centering seal via a web. In this case, the vertically movable lifting plate can be eliminated in favor of bases fixed in height. This design is in particular advantageous for cans, since here the filling level is customarily close to the upper can edge.

We claim:

1. A process for the sterile filling of beverage liquids into bottles comprising the steps of:

a) lifting a bottle vertically upwardly from below toward filling element having a feed pipe affixed thereto in a positioning phase so that an outlet opening of the feed pipe at an end thereof and opening essentially in the axial direction of the pipe lies within the bottle in the area of the head of the bottle and below the bottle's opening, a space being provided between an outer casing of the feed pipe and the inner wall of the head of the bottle;

b) introducing steam into the bottle through said feed pipe and out of said outlet opening thereof in the axial direction of the pipe toward the bottom of the bottle in a relatively powerful and bundled jet in a sterilization phase to sterilize the interior of the bottle;

c) introducing an inert counter-pressure gas into the bottle through said feed pipe in a counter-pressurizing phase to generate a counter-pressure in the bottle;

d) filling a beverage liquid into the bottle in a filling phase by flowing the liquid down and around the outer casing of the feed pipe and through said space, the counter-pressure gas simultaneously being forced out by the liquid through said feed pipe; and e) lowering the bottle vertically downwardly away from the element in a withdrawal phase after the desired level of liquid in the bottle has been reached.

2. The process of claim 1, wherein in the positioning phase the bottle is lifted to a position slightly below the filling element so that the bottle's opening is not pressed against the filling element and a gap remains between the bottle's opening and the element, the sterilization phase being carried out with the bottle in this position.

3. The process of claim 1 or 2, including introducing counter-pressure gas into the bottle through said feed pipe to preflush the bottle in a preflushing phase between the sterilization phase and the counter-pressurizing phase.

4. The process of claim 1 or 2, wherein the bottle is pressed against a seal on the filling element in a pressure-tight manner prior to and during the counter-pressurizing phase.

5. The process of claim 1, wherein the bottle is pressed against a seal on the filling element in a pressure-tight manner in the positioning phase.

6. The process of claim 5, including drawing a vacuum on the interior of the bottle through the feed pipe to preevacuate the bottle in a preevacuation phase between the positioning phase and the sterilization phase.

7. The process of claim 5 or 6, including drawing a vacuum on the interior of the bottle through the feed pipe to evacuate the bottle in an evacuation phase between the sterilization phase and the counter-pressurizing phase.

8. The process of claim 5, including a step of preflushing the bottle, after the sterilization phase and before the counter-pressurizing phase, in a preflushing phase with counter-pressure gas introduced through the feed pipe, the gas in the preflushing phase pushing the steam from the sterilization phase and any condensate formed as a result of sterilization out of the bottle's opening through a discharge line communicating with the bottle's opening.

9. The process of claim 8, wherein the discharge line is closed at the termination of the preflushing phase.

10. The process of claims 9, wherein the discharge line is closed by lifting the bottle towards the filling element.

11. The process of claim 1, including only partly withdrawing the bottle initially from the filling element in the withdrawal phase, then flushing the bottle's opening with an inert gas fed through the feed pipe and thereafter completely withdrawing the bottle from the filling element.

12. The process of claim 1, wherein the filling element includes a liquid valve for controlling the flow of liquid into the bottle in the filling phase, the feed pipe for introducing said steam passing through said valve.

13. The process of claim 1, wherein the filling element includes a baffle body and the liquid is directed toward the inner walls of the bottle's head by said baffle body during the filling phase.

* * * * *